US010849373B2

(12) United States Patent
Wright

(10) Patent No.: US 10,849,373 B2
(45) Date of Patent: Dec. 1, 2020

(54) ELECTRO ILLUMINATING WIRE LIGHTED SAFETY VESTS

(71) Applicant: Rayma Charlene Wright, Las Vegas, NV (US)

(72) Inventor: Rayma Charlene Wright, Las Vegas, NV (US)

( * ) Notice: Subject to any disclaimer, the term of this patent is extended or adjusted under 35 U.S.C. 154(b) by 0 days.

(21) Appl. No.: 16/522,845

(22) Filed: Jul. 26, 2019

(65) Prior Publication Data

US 2019/0373965 A1 Dec. 12, 2019

Related U.S. Application Data

(63) Continuation of application No. 15/423,386, filed on Feb. 2, 2017, now Pat. No. 10,405,588, which is a continuation-in-part of application No. 13/915,646, filed on Jun. 12, 2013, now abandoned.

(60) Provisional application No. 61/661,253, filed on Jun. 18, 2012.

(51) Int. Cl.

| | |
|---|---|
| ***A41D 13/01*** | (2006.01) |
| ***A41D 1/04*** | (2006.01) |
| ***A41D 27/20*** | (2006.01) |
| ***G08B 5/00*** | (2006.01) |
| ***F21V 33/00*** | (2006.01) |

(52) U.S. Cl.

CPC ..... *A41D 13/01* (2013.01); *A41D 1/04* (2013.01); *A41D 27/205* (2013.01); *G08B 5/004* (2013.01); *F21V 33/0008* (2013.01)

(58) Field of Classification Search

CPC ..... A41D 1/04; A41D 13/01; A41D 27/085; A41D 27/205; F21V 33/008; F21V 33/0008; F21S 4/26; G08B 5/004

See application file for complete search history.

(56) References Cited

U.S. PATENT DOCUMENTS

| | | | | |
|---|---|---|---|---|
| 5,567,040 | A * | 10/1996 | Tabanera | A41D 13/01 362/103 |
| 5,570,945 | A | 11/1996 | Chien et al. | |
| 5,879,076 | A | 3/1999 | Cross | |
| 6,146,006 | A * | 11/2000 | Cross | F21L 2/00 362/555 |
| 6,179,440 | B1 | 1/2001 | Palmer | |
| 6,450,678 | B1 * | 9/2002 | Bayersdorfer | B60Q 3/54 362/488 |
| 6,517,214 | B1 | 2/2003 | Mitchell, Jr. et al. | |
| 6,592,238 | B2 | 7/2003 | Cleaver et al. | |
| 6,769,138 | B2 | 8/2004 | Golle et al. | |
| 6,874,924 | B1 | 4/2005 | Hulse et al. | |
| 6,974,239 | B2 | 12/2005 | Currie et al. | |
| 7,377,663 | B2 | 5/2008 | Desjardin | |

(Continued)

*Primary Examiner* — Alan B Cariaso

(74) *Attorney, Agent, or Firm* — Armstrong Teasdale LLP

(57) ABSTRACT

A garment includes a flexible layer of material configured to fit a contour of a body, a first length of an electro illuminating (EL) wire assembly is coupled to the flexible layer. The EL wire assembly includes a tubular sheath at least partially surrounding a second length of an EL wire. The tubular sheath includes a hollow interior and a water resistant outer surface. The outer surface includes one or more attachment tabs extending away from the outer surface. The EL wire assembly is attached to the garment via the one or more attachment tabs. A battery pack includes an electrical energy storage device electrically coupled to the EL wire assembly.

6 Claims, 6 Drawing Sheets

(56) References Cited

U.S. PATENT DOCUMENTS

| | | | | |
|---|---|---|---|---|
| 7,874,691 | B2 | 1/2011 | Kormos | |
| 8,215,810 | B2 * | 7/2012 | Welch, Sr. | B60N 2/58 362/488 |
| 8,288,940 | B2 | 10/2012 | Hehenberger | |
| 2001/0004808 | A1 | 6/2001 | Hurwitz | |
| 2001/0048603 | A1 | 12/2001 | Ohuchi | |
| 2003/0035917 | A1 | 2/2003 | Hyman | |
| 2004/0032747 | A1 | 2/2004 | Currie et al. | |
| 2004/0164683 | A1 * | 8/2004 | Bettis | A41D 13/01 315/169.3 |
| 2005/0125874 | A1 | 6/2005 | DeVore | |
| 2006/0034064 | A1 | 2/2006 | Kanzler et al. | |
| 2006/0092625 | A1 | 5/2006 | McKowen | |
| 2007/0275620 | A1 | 11/2007 | Den Toonder et al. | |
| 2008/0170383 | A1 | 7/2008 | Reason | |
| 2009/0313869 | A1 | 12/2009 | Zemmouri et al. | |
| 2010/0003496 | A1 | 1/2010 | Dias et al. | |
| 2011/0164406 | A1 | 7/2011 | Chen | |
| 2011/0199779 | A1 * | 8/2011 | Chu | F21V 33/0008 362/551 |
| 2013/0077289 | A1 | 3/2013 | Gridley | |
| 2014/0347845 | A1 * | 11/2014 | Pulido, Jr. | A43B 3/001 362/103 |

* cited by examiner

ELECTRO ILLUMINATING WIRE LIGHTED SAFETY VESTS

CROSS REFERENCE TO RELATED APPLICATIONS

This application is a continuation application of application Ser. No. 15/423,386 filed Feb. 2, 2017, which is a continuation-in-part application of application Ser. No. 13/915,646 filed Jun. 12, 2013, and claims priority from Provisional Application No. 61/661,253 filed Jun. 18, 2012 entitled "EL Wire lighted safety vests," all of which are hereby incorporated by reference in their entirety.

BACKGROUND

There are many occupations, sports, and hobbies that require specific safety measures in order to prevent injury. Many of these measures rely on increasing the visibility of a user or location. Specifically, brightly colored vests worn to increase the visibility of a person are typically worn by many workers to enhance their safety. Police officers often wear safety vests when directing traffic or working an accident scene. These vests are often worn over their garments and are made in high-visibility colors such as neon orange, yellow, or green. To increase visibility, these vests often include reflective tape to reflect the light from car headlights when used at night. Likewise, similar safety vests are worn by Department of Transportation personnel and many other persons whose occupations require them to work in close proximity to highways and other means of high vehicular traffic. Additionally, airport personnel use high-visibility safety vests when working on the ramp area around aircraft.

Another segment of society that often utilize high-visibility safety vests are people participating in sports such as hunting, fishing, cycling, snow skiing, and running. All of these sports rely on these vests to highlight the participant in order to protect them from being shot by other hunters or hit by vehicles whose drivers would not otherwise see them without a safety vest. Another benefit of using safety vests when participating in certain sports allow the wearer to be more closely tracked to prevent them or their companions from becoming lost. Hunter and fishermen often hunt and fish with others, but may become separated as they wander the woods or downstream from one another. By wearing brightly colored vests, the hunters or fishermen can better keep track of one another since the vests allow them to see each other from greater distances than would otherwise Even though these high-visibility safety vests greatly improve the chance that a wearer of the vest will be seen by others, certain limitations still exist. First, a brightly colored vest may be adequate for certain applications when used in a well-lit environment, but the ability for a colored vest to distinguish a wearer from the surrounding environment greatly diminishes as the ambient light also diminishes. As mentioned above, reflective tape is sometimes used to increase the visibility of a vest. This tape works well as long as the light source, i.e. headlights, is directed to the tape, but diminishes as the light source moves away from the reflective tape. This attribute of the reflective tape creates a hazard for workers in certain situations. For example, a person working at a location such as an intersection, where a vehicle might turn towards them only when it is already close to the worker, might not be seen until it is too late since the headlights of the vehicle will not shine in the direction of the worker until the vehicle turns in that direction.

Additionally, most safety vests described above will not aid sportsmen in keeping within sight of one another once ambient light diminishes to the point that the vest can no longer be seen. Reflective tape does not help in this situation as the person as the person wearing the vest may be too far away from a person with a light source such as a flashlight.

There are safety vests that have self-illumination features, such as vests made by POLYBRITE INTERNATIONAL of Naperville, Ill. These vests and others with illumination features only provide a user with a single safety feature, namely illumination, manufactured in a single configuration. A user may have the option of turning the illumination on and off, but is left with the particular configuration of reflective tape and the illumination sources established by the manufacturer. Additionally, light-emitting diodes (LEDs) are often left unprotected and susceptible to damage.

U.S. Pat. No. 4,891,896 issued on Jan. 9, 1990 to Boren and assigned to the Gulf Development Company is an example of many attempts to duplicate neon lighting. Like this attempt, most prior art neon simulations have resulted in structures difficult to fabricate and providing a little in the way of weight and handling benefits. The Boren patent exemplifies this by providing a plastic panel with essentially bas-relief lettering. The material comprising the lettering is transparent and coated with a translucent material. The surrounding material is opaque. When the panel is back lit the letting tends to glow with a neon-like intensity.

The more recent introduction of light weight and breakage resistant point light sources as exemplified by high intensity light emitting diodes ("LEDs") have shown great promise to those interested in illumination devises that may simulate neon lighting and have stimulated much effort in that direction. However, the twin attributes of neon lighting, uniformity and brightness, have proven to be difficult obstacles to hurdle as such attempts to simulate neon lighting have largely been stymied by the tradeoffs between light distribution to promote the uniformity and brightness. For example, U.S. Pat. No. 4,976,057 issued Dec. 11, 1990 to Bianchi describes a device that includes a transparent or translucent hollow plastic tubing which is mounted in juxtaposition to a sheet of material having light transmitting areas that are co-extensive to the tubing. The tubing can be made into any shape including lettering. While the tubing may be lit by such arrangement is likely to result in a "glowing" tube having insufficient intensity to match that of neon lighting. The use of point light sources such as LEDs may provide intense light that rival or exceed neon lighting, but when arranged in arrays lack the uniformity needed and unfortunately provide alternate high and low intensity regions in the illuminated surfaces. Attempts to smooth out the light have resulted in lighting that has unacceptably low intensity levels.

It is therefore a paramount object of the present invention to provide for an energy efficient, virtually unbreakable alternative to neon lighting.

A further important object of the present invention is to provide for a light device that is safe to transport and economical to operate while providing all of the application virtues of neon lighting including uniformity and brightness.

Yet another object of the present invention is to provide for an alternative to neon lighting that is environmentally friendly, requiring no neon gas, and running on significantly less electricity that its neon equivalent.

Still another object of the present invention is to provide for a neon equivalent that is easy to install without complex high voltage electrical installations.

These and other objects of the present invention will become readily apparent and addressed through a reading of the discussion below and appended drawings.

BRIEF DESCRIPTION

The present invention utilizes a material having wire-like characteristics that preferentially solid light entering a lateral surface of the wire ("light emitting surface") is elongated along the length of the wire. A light source extends along and is positioned adjacent the light receiving surface and spaced from the light emitting surface a distance sufficient to create an elongated light intensity pattern along the length of the wire. In a preferred arrangement, the light source is a wire-like solid light sufficient to permit the mapping of the light emitted so as to create elongated light intensity pattern along the light emitting surface and circumferentially about the surface so that the collective light intensity pattern is perceived as being uniform over substantially the entire surface when being viewed from a normal head-on and side perspectives.

In one aspect, a garment includes a flexible layer of material configured to fit a contour of a body, a first length of an electro illuminating (EL) wire assembly is coupled to the flexible layer. The EL wire assembly includes a tubular sheath at least partially surrounding a second length of an EL wire. The tubular sheath includes a hollow interior and a water resistant outer surface. The outer surface includes one or more attachment tabs extending away from the outer surface. The EL wire assembly is attached to the garment via the one or more attachment tabs. A battery pack includes an electrical energy storage device electrically coupled to the EL wire assembly.

BRIEF DESCRIPTION OF THE DRAWINGS

FIG. 1, is a Front view of a standard well known Safety Vest, with an elevated perspective view of encased Electro Illumination Wire for protection then attachment, of the present invention;

FIG. 2, is a back view of a safety vest illustrating attachment of electro illumination wire in accordance with one embodiment of the present invention;

FIG. 3, is a side view of attachment of electro illumination wire within a protective cover, and showing the flexibility with one embodiment of the present invention;

FIG. 4, is the left inside view of safety vest and showing how the inside pocket secures the AA-battery pack in place;

FIG. 5, is a top elevation view of attaching the electro illumination wire, as positioned in the present invention;

FIG. 6, is an enlarged view of the electro illumination wire, attached under the reflective strip edge and on top of the safety vests mesh to secure electro illumination wire with in the present invention;

FIG. 7, is an elevated view of the clear material used to protect electro illumination wire and secure it to the safety vest of the present invention;

FIG. 8, is a partially explored view of a battery pack, illustrating, detachable connectors, off/on button, in accordance with embodiment of the present invention; and FIG. 9 show, respectively, a safety vest being worn and illustrating the light distribution characteristics of a single point light source within a device constructed in accordance with the present invention.

Although specific features of various embodiments may be shown in some drawings and not in others, this is for convenience only. Any feature of any drawing may be referenced and/or claimed in combination with any feature of any other drawing.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

The following description refers to the accompanying drawings, in which, in the absence of a contrary representation, the same numbers in different drawings represent similar elements.

The present invention now will be described more fully hereinafter with reference to the accompanying drawings, in which illustrative embodiment of the invention are shown. This invention may, however, be embodied in many different forms and should not be construed as limited to the embodiment set forth herein; rather, these embodiments are provided so that this disclosure will be thorough and complete, and will fully convey the scope of the invention to those skilled in the art. Like numbers refer to like elements throughout.

For the people working or participating in sports or hobbies in close proximity to motor vehicles, aircraft, or other potential dangers, being visible could mean the difference between life and death. Aspects of the present invention provide improved safety vests and garments to be utilized by police, firemen, airport ramp workers, department of transportation personnel, construction workers, refuse collectors, military personnel, coast guards, ship operator and employees, hunters, runners, snow skiers, cyclists, and any other persons relying on enhanced visibility to ensure their safety. Safety vests and safety garments according to aspects of the present invention provide users with increased visibility in low light, poor weather conditions utilizing self-illumination that does not rely on reflecting light from sources outside of the safety garments. The safety garments illumination sources are protected increasing the durability and life of the safety garments. Embodiments of the present invention provide personnel not only increased safety, but also increased utility through flexible options and features. It should be understood by those skilled in the art that while the following description utilizes a safety vest to illustrate embodiments of the present invention, the invention is equally applicable to other garments such as hats, gloves, belts, pants and rain gear.

Figure 1:
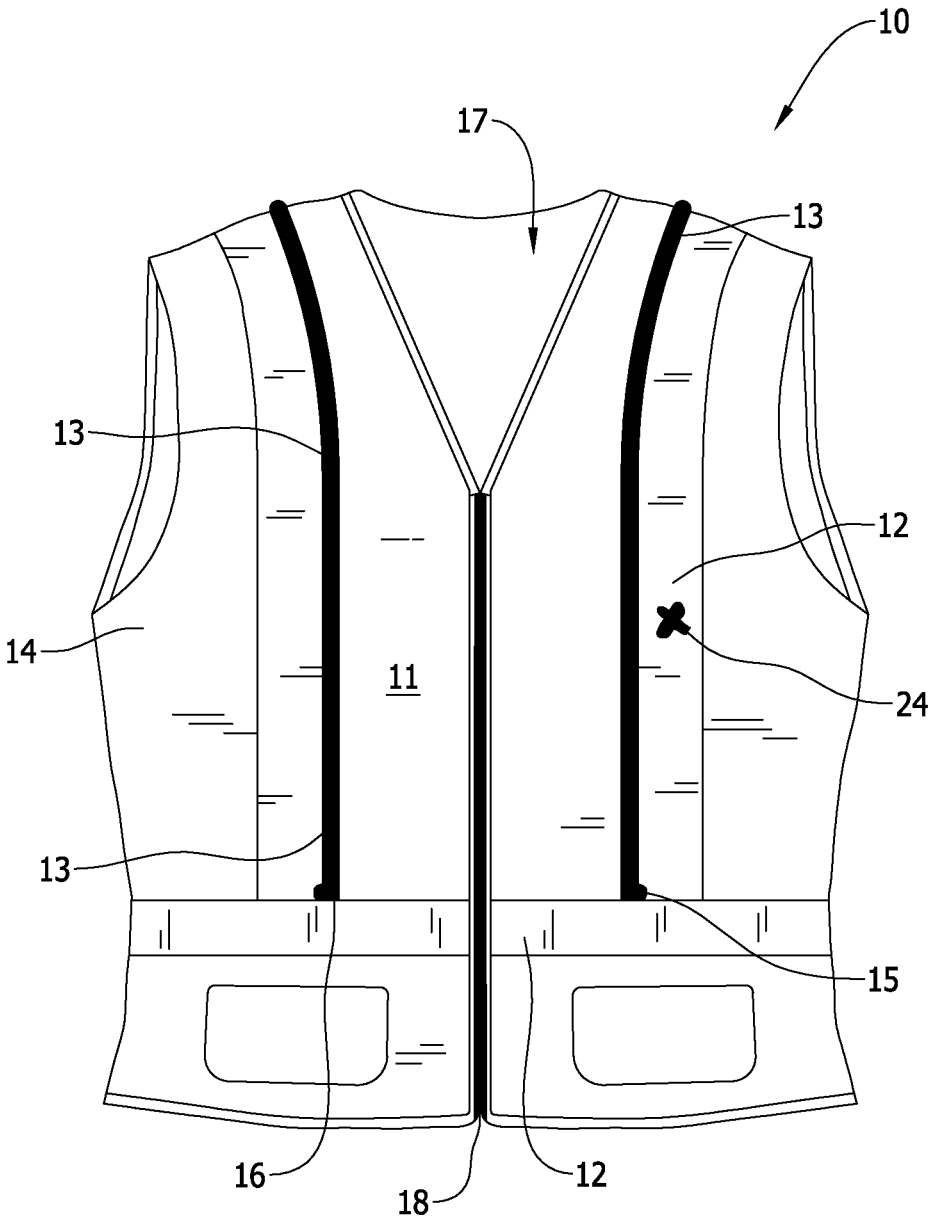
FIGS. 1-9 show example embodiments of the method and apparatus described herein.
Figure 5:
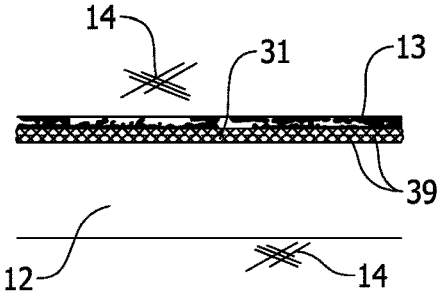
Figure 9:
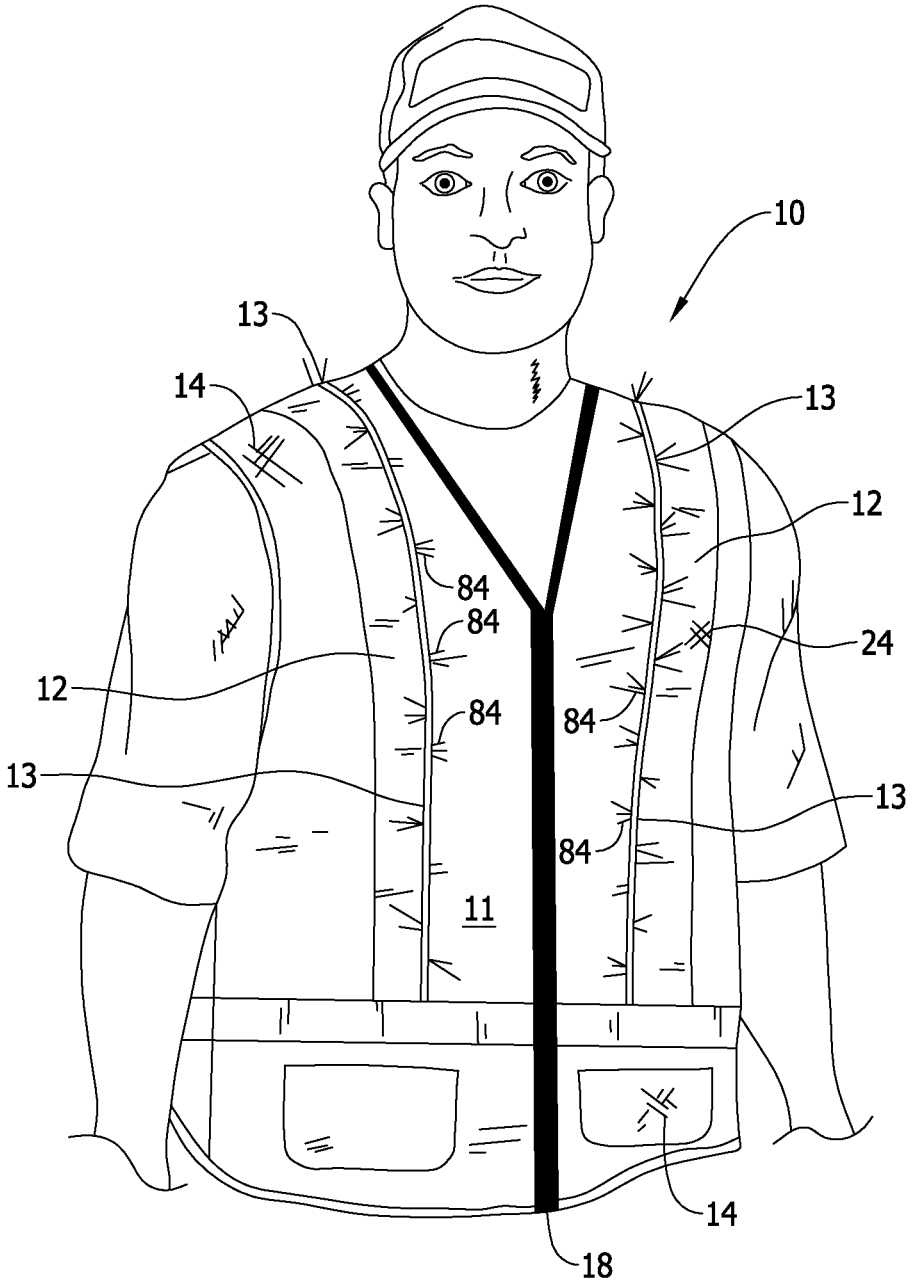

FIG. 1 Illustrates a front view 11 of the safety vest 10, according to one embodiment of the present invention. Safety vest 10 is preferably made from mesh 14 to allow air to penetrate the vest for the comfort of the wearer, but may be any other suitable material. To avoid confusion, only a portion of the safety vest 10 shown in FIG. 1 and FIG. 9 is shown as mesh 14, but it is to be understood that the entire surface may be mesh 14. Mesh 14 may be a bright color to provide a sharp contrast with the surrounding environment of a wearer in order to attract attention, such as neon orange, neon green, or neon yellow. When safety vest 10 is warn, the wearer will have a front closing with a zipper 18 to secure the safety vest 10 in place, respectively using any fastening means now known or developed in the future, but may also be secured using snaps, buttons, hook and loop material, or any combination thereof. It should be appreciated that any safety vest 10 designs, market availability is equally applicable to the embodiments of the present invention described herein. Safety vest 10 has a plurality of reflective strips 12 attached to the mesh 14. Reflective strips 12 add to the visibility of the safety vest 10 since they have a reflectance that is greater than that of the mesh 14. Because reflective strips 12 reflect more light than mesh 14, they are more easily seen in low-light conditions with the aid of outside light source such as headlights of an automobile. Reflective strips 12 are sewn 39 to mesh 14. FIG. 5 shows how an electro illumination (EL) wire assembly 13 is attached by sewing 39 under the edge of reflective strip 12 enhancing the visibility of the safety vest 10. Aperture 15 is where electro illumination wire 13 exits inside pouch to front of the safety vest 10 for application.

Figure 2:
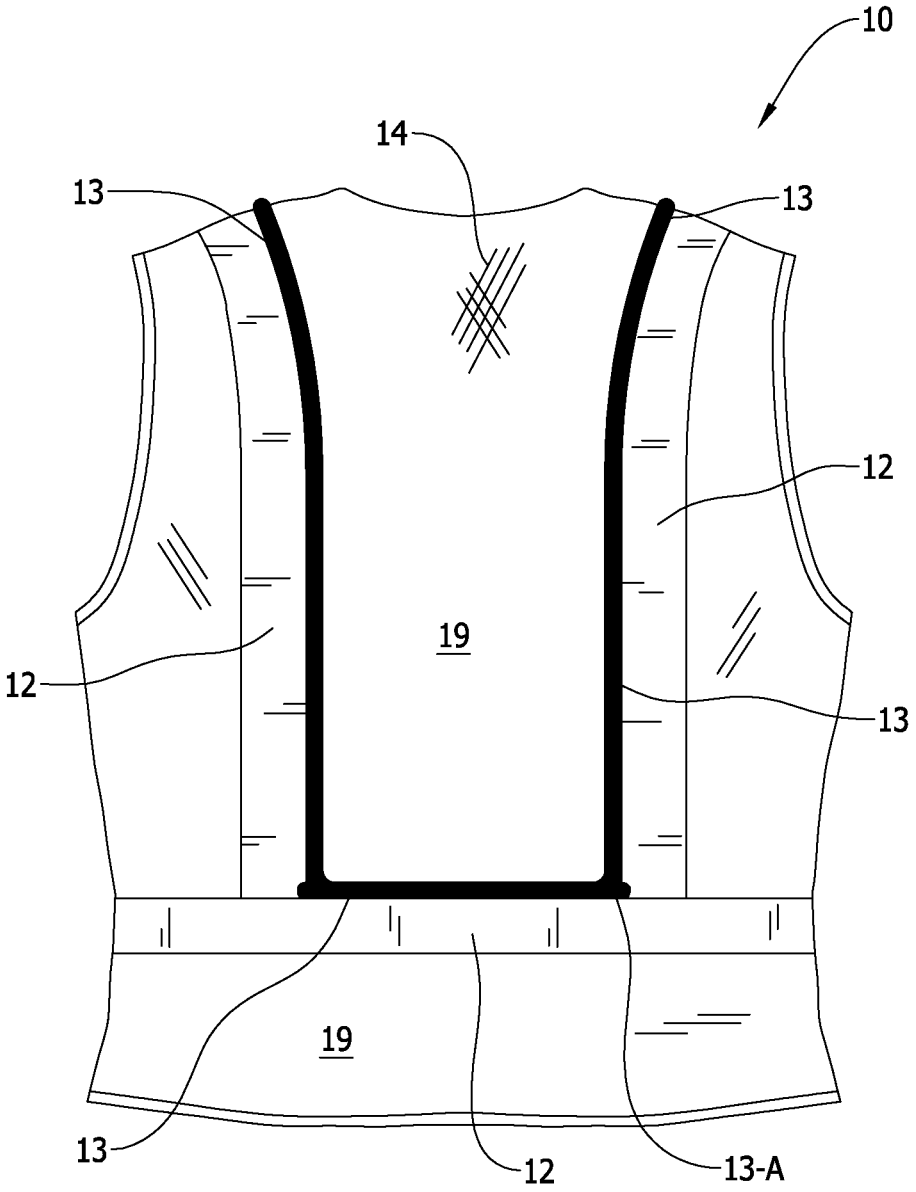

FIG. 2 shows the back view of the safety vest 10, according to the embodiment of the present invention. By physically attaching electro illumination wire 13 causes a new environment and gives the wearer room on the back, and front for identification. For example, the safety vest 10, may be marked with letter "POLICE," "DOT", "UNITED ARMED FORCES," a company name, or any other identifying insignia corresponding to the name, or any other identifying insignia corresponding to the wearer. Alternatively, mesh 14 may be marked with messages such as "CAUTION" or "SLOW". These identifiers and messages may be printed on the mesh 14 using a contrasting color, or may be created using reflective strips 12. It is to be understood the reflective strips 12 may be secured to the mesh 14 in any pattern or configuration.

Figure 3:
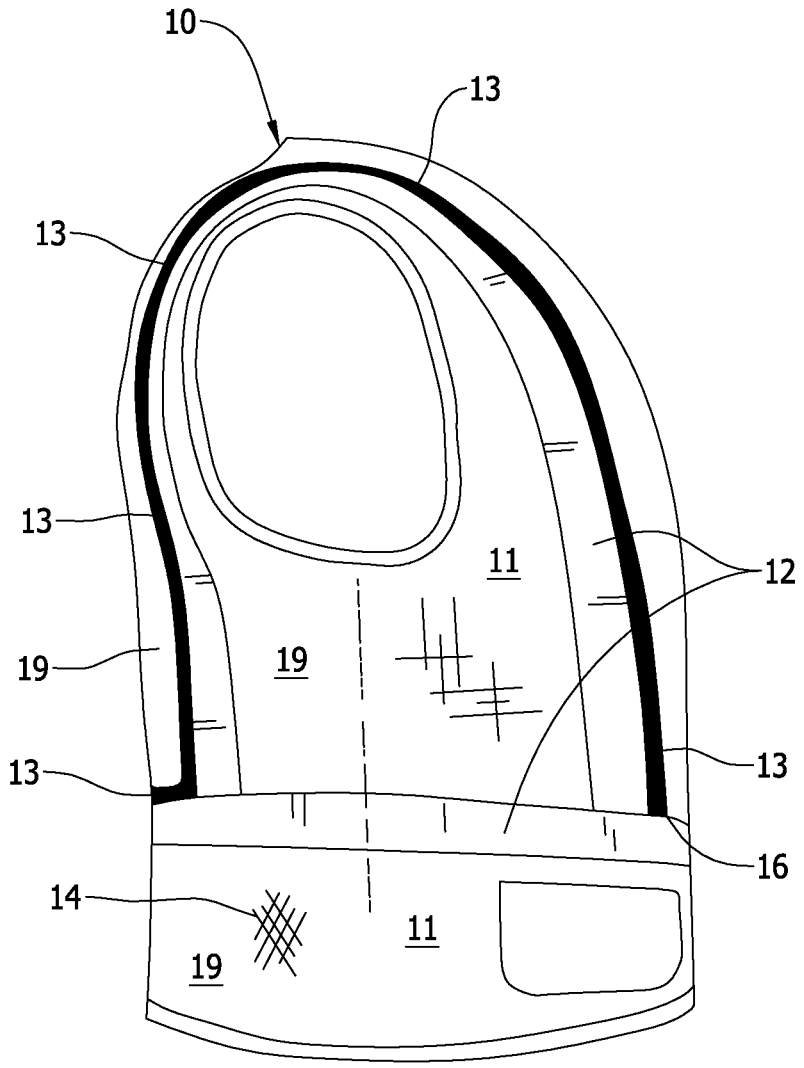

FIG. 3 shows a side view of safety vest 10, 19 back of safety vest 10.11, front of safety vests 10. The flexibility of electro illuminating wire 13 around the back right corner 13-A of safety vest 10, demonstrating the ability to bend electro illuminating wire 13 up to the right side shoulder and down to the right front to aperture 15, exiting inside waist of the safety vest 10 and secured.

Figure 4:
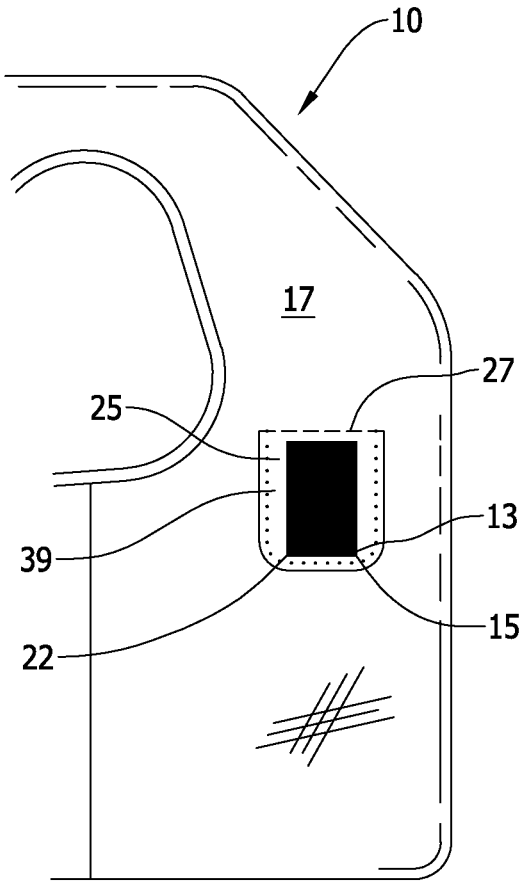

FIG. 4 shows an inside view of safety vest 10, which includes a pouch 25. Pouch 25 with top opening 27, is preferably made of mesh 14 and sewn 39 to the inside of safety vest 10. It is understood that the pouch 26 may be made from any material and secured in any location on safety vests 10. Inside safety vest 10 shows the placement of pouch 26 inside 17 of safety vest 10.

FIG. 5 is a side view of the attachment of the electro illumination wire 13 to the edge of reflective strip 12 by stitching 39 through reflective strip 12, mesh 14, and an attachment tab 31. Attachment tab 31 extends outwardly away from protective cover 30. Attachment tab 31 may extend radially outwardly (as shown) or tangentially outwardly away from protective cover 30. By physically attaching electro illumination wire 13 by sewing 39 attachment tab 31 under edges of reflective strips 12 and on top of mesh 14, creates a secure and safe, new environment. It is to be understood the electro illumination wire 13 may be secured to the safety vest 10 in any pattern or configuration.

Figure 6:
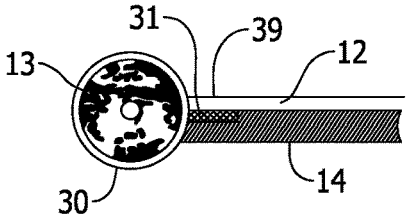

FIG. 6 illustrates a cross section of electro illumination wire 13 and attachment. Electro illumination wire 13 is protected by clear protective cover 30. Protective cover 30 includes attachment tab 31. Placed between bottom edge of reflective strip 12 and top of mesh 14, sewing 39, secures electro illumination wire 13 securely in place. It is to be understood the electro illumination wire 13 may be secured to the safety vest 10 in any pattern or configuration.

Figure 7:
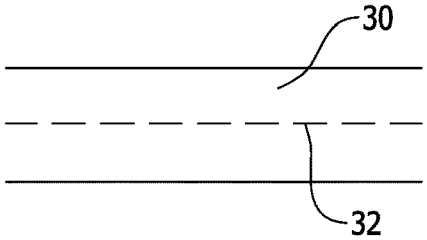

FIG. 7 is a side view of EL wire 13 including a protective cover 30. It is to be understood that protective cover 30 is market available, may be any shape. Protective cover 30 is preferably made of durable, stretch-resistant, heat-resistant material to ensure long life. FIG. 7, 32 shows a center of protective cover 30.

Figure 8:
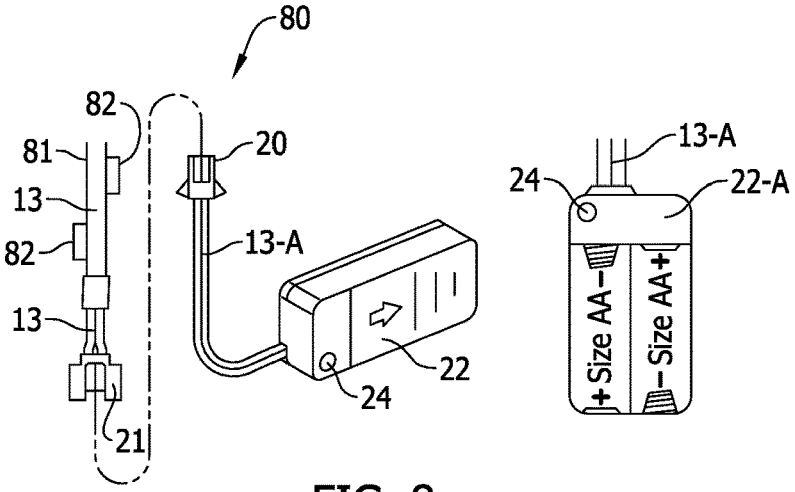

FIG. 8 is a schematic view of electrical connecting components used with EL wire 13. A power source 22, such as, but not limited to a battery pack is used to power electro illumination wire assemblies 13 through connecting electrical wires and further includes an on/off button 24 that is secured in a location inside safety vest 10, FIG. 4. In one embodiment, a location of on/off button 24 is behind reflective strip 12, on front of safety vest 10, FIG. 1 and FIG. 9. Reference numeral 24 indicates location of secured on/off button 24. Power source 22 is preferably uses two AA-sized batteries, but maybe any number of or size of batteries sufficient to provide power to electro illumination wire 13 depending on the length and width of electro illumination wire 13 to the power source. In various embodiments, power source 22 rests in a pouch 26 sewn 39 to the interior of the safety vest 10. A wearer presses a marked location 24 on the reflective strip 12 in order to activate and deactivate the electro illumination wire 13. The circuit components are hidden and protected from damage due to ordinary wear and tear from use of the safety vest 10. The wearer of safety vest 10 has easy access to the on/off button 24, while the button 24 remains protected for durability purposes. It is also to be understood that the electro illumination wire 13 assemblies and corresponding wiring and circuitry may be located on safety vest 10 separate from the reflective strip 12. The safety vest 10, may be water-resistant or waterproof, if power source 22 is behind reflective strip 12, on front of safety vest 10, FIG. 1 and FIG. 9, 24 indicates location of secured on/off button 24. In various embodiments, power source 22 includes two AA-sized batteries, but may be any number of or size of batteries sufficient to provide power to electro illumination wire 13 depending on the length and type of electro illumination wire 13 to the power source.

FIG. 9 Illustrates electro illumination wire 13, attached to reflective strip 12. Off/on button 24 is shown on front view 11 of FIG. 9, marked on the reflective strip 12, placed for ease of wearer to activate or deactivate on/off button 24. Safety vest 10 is shown of mesh 14. FIG. 9 shows an example of a zipper 18 for front closure. Showing how its look is impressive to automobile drivers, cyclists, walkers, truck drivers, anyone on the roadways. Wearers do not have to depend on automobile headlights to be seen, thereby protecting them from injury or even death.

It should be understood that application of electro illumination wire to a market available safety vest, may be located anywhere on the front and back of safety vests. Electro illumination wire is light weight, resistance to the rigors of packing, handling, shipping, and installation, and the minimal heating aspect of the electro illumination wire, permits essentially endless possibilities for lighting and color sequences. The electro illumination wire, may for example, be provided with various electrical components that permit flashing of the light sources in varied timed sequences and give the effect of moving. Various light source colors may be used with the present invention. From the discussion above, it may be appreciated that the electro illumination wire of the present invention is rugged and resists breakage that normally would be expected for neon or LED lighting counterparts in shipping and handling. The electro illumination wire preferably solid state lighting such as electro illumination wire uses far less electrical energy and remains cool to touch. This allows the electro illumination wire of the present invention to be used in places where the heat generated by neon and LED lighting precludes its use. Moreover, the light weight of the electro illumination wire facilitates mounting on support structures that could not support the relative weight of the neon and led lighting, and its required accessories including the high voltage infrastructure behind reflective strip 12, on front of safety vest 10, FIG. 1 and FIG. 9.

It should be understood that application of electro illumination wire to a market available safety vest, may be located anywhere on the front and back of safety vests. Electro illumination wire is light weight, resistance to the rigors of packing, handling, shipping, and installation, and the minimal heating aspect of the electro illumination wire, permits essentially endless possibilities for lighting and color sequences. The electro illumination wire, may for example, be provided with various electrical components that permit flashing of the light sources in varied timed sequences and give the effect of moving. Various light source colors may be used with the present invention. From the discussion above, it may be appreciated that the Electro Illumination Wire of the present invention is rugged and resists breakage that normally would be expected for neon or LED lighting counterparts in shipping and handling. The electro illumination wire preferably solid state lighting such as electro illumination wire uses far less electrical energy and remains cool to touch. This allows the electro illumination wire of the present invention to be used in places where the heat generated by neon and led lighting precludes its use. Moreover, the light weight of the electro illumination wire facilitates mounting on support structures that could not support the relative weight of the neon and led lighting, and its required accessories including the high voltage infrastructure.

Finally, the electro illumination wire is flexible in its use, allowing a tremendous variety of lighting techniques very difficult to obtain in neon and led lighting without substantial expense. Other advantages and uses of the present invention will be clearly obvious to those skilled in the art upon reading of the disclosure herein and are intended to be covered by the scope of the claims set forth.

The above specification, examples and data provide a complete description of the manufacture and use of the composition of the invention. Since many embodiments of the invention can be made without departing from the spirit and scope of the present invention, the invention resides in the claims hereinafter appended.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A safety vest comprising:

a first layer comprising a mesh or fabric material comprising a reflective surface having a first reflectance;

a second layer coupled to said first layer, the second layer comprising a reflective tape having a second reflectance, the second reflectance being greater than the first reflectance; and a predetermined length of electro illuminating (EL) wire secured under an edge of said second layer said EL wire at least partially enclosed in a water resistant sheath comprising an arcuate cross-section portion and an attachment tab portion extending away from a surface of said arcuate cross-section portion, said EL wire coupled between said first layer and said second layer using sewn stitches or an adhesive.

2. The safety vest of claim 1, further comprising:

a power source configured to couple to said EL wire; and a pocket attached to an inside surface of said first layer, said pocket sized for receiving and securing said power source secure and in place.

3. The safety vest of claim 2, wherein the attachment tab portion extends radially away from the outer surface.

4. The safety vest of claim 2, wherein said sheath is at least one of translucent and transparent.

5. The safety vest of claim 2, wherein said sheath is at least partially internally reflective.

6. The safety vest of claim 1, wherein said power source comprises a control circuit configured to cause said EL wire to provide at least one of a solid illumination and a blinking illumination.

* * * * *